US006877439B2

(12) United States Patent
Chapman

(10) Patent No.: US 6,877,439 B2
(45) Date of Patent: Apr. 12, 2005

(54) TRANSPORTATION SYSTEM

(76) Inventor: Lawrence Hugh Chapman, 59 Felton Mathew Avenue, St. Johns, Auckland 1005 (NZ)

( * ) Notice: Subject to any disclaimer, the term of this patent is extended or adjusted under 35 U.S.C. 154(b) by 0 days.

(21) Appl. No.: 10/363,785

(22) PCT Filed: Sep. 7, 2001

(86) PCT No.: PCT/NZ01/00184

§ 371 (c)(1),
(2), (4) Date: Jun. 23, 2003

(87) PCT Pub. No.: WO02/20325

PCT Pub. Date: Mar. 14, 2002

(65) Prior Publication Data

US 2004/0025738 A1 Feb. 12, 2004

(30) Foreign Application Priority Data

Sep. 8, 2000 (NZ) ..... 506819

(51) Int. Cl.[7] ..... E01B 29/24
(52) U.S. Cl. ..... 104/118; 104/124; 104/89
(58) Field of Search ..... 104/124, 125, 104/126, 95, 93, 89, 106, 27, 28, 118, 119; 105/105, 154, 155

(56) References Cited

U.S. PATENT DOCUMENTS

| | | | | | |
|---|---|---|---|---|---|
| 843,418 | A | * | 2/1907 | Romanoff | 104/93 |
| 1,149,764 | A | * | 8/1915 | Hinsen | 104/115 |
| 1,958,889 | A | * | 5/1934 | Fish | 52/297 |
| 2,781,001 | A | * | 2/1957 | Davino | 104/89 |
| 3,118,392 | A | | 1/1964 | Zimmerman | |
| 3,236,193 | A | * | 2/1966 | Chadenson et al. | 104/94 |
| 3,861,319 | A | * | 1/1975 | Gelhard et al. | 104/124 |
| 4,000,702 | A | | 1/1977 | MacKintosh | |
| 4,630,216 | A | * | 12/1986 | Tyler et al. | 700/229 |
| 4,792,036 | A | * | 12/1988 | Heidelberg | 198/619 |
| 4,841,871 | A | * | 6/1989 | Leibowitz | 104/23.1 |
| 5,168,451 | A | * | 12/1992 | Bolger | 701/117 |
| 5,797,330 | A | * | 8/1998 | Li | 104/28 |
| 5,799,263 | A | * | 8/1998 | Culbertson | 701/117 |
| 5,813,349 | A | * | 9/1998 | Jensen | 104/28 |
| 6,321,657 | B1 | * | 11/2001 | Owen | 104/119 |

FOREIGN PATENT DOCUMENTS

| | | | |
|---|---|---|---|
| DE | 25 17 884 | A | 11/1976 |
| DE | 41 41 426 | A | 6/1993 |
| DE | 41 41 426 | A1 * | 6/1993 |

* cited by examiner

*Primary Examiner*—Frantz F. Jules
(74) *Attorney, Agent, or Firm*—Lowe Hauptman & Berner, LLP

(57) ABSTRACT

The present invention relates to an improved transportation system which includes a plurality of upright supports (1) which elevate at least one track (2). A plurality of cabs (3) are adapted to move along the track or tracks (2) provided where the cabs (3) suspended from a track (2) so that the center of mass of the cabs (3) is located below the track (2). A single track (2) provides a pair of rail elements on opposite sides of the track (2) where the first rail element is adapted to support cabs (3) moving in substantially the opposite direction to cabs (3) supported by the second rail element of the same track (2).

26 Claims, 7 Drawing Sheets

TRANSPORTATION SYSTEM

This invention relates to improvements to or associated with transportation systems. Specifically the present invention may be adapted to provide a public transportation system which can be implemented or installed in a large range of locations, which is cost effective to implement, and which can run or service low volumes of passenger numbers if required.

Reference throughout this specification will also be made to the present invention being used in the transportation of passengers, but those skilled in the art should appreciate that other applications or cargoes are envisioned and reference to the above only throughout this specification should in no way be seen as limiting.

BACKGROUND ART

Public transport systems are promoted in most major cities to reduce road congestion and the pollution problems caused by high levels of road vehicle use.

In some instances road buses are promoted as an alternative to the public using their own cars for transport within a city. However, buses are relatively large vehicles and not very cost efficient if there are only a small number of passengers who are prepared to use the bus service. Buses are also slow compared to private cars and are vulnerable to delays caused by road congestion problems. Buses will still contribute to the air and noise pollution problems faced by most cities.

One other type of public or passenger transportation system proposed for intra-city travel is trains and rail networks. However, known types of rail networks also have a number of disadvantages associated with their use.

A rail network must use large areas of land in central locations as well as expensive locomotives and carriages to transport passengers. These two factors combined make the construction, implementation and maintenance of a rail network an expensive proposition. Furthermore, large scale rail networks are also limited in the areas of a city in which they can transport passengers. It may be difficult for the builders of a rail network to secure all the land they require to extend networks out to all destinations of interest to the network's passengers. The high capital costs associated with building such a network may also limit the size or extent of the network that can be built for available funds.

Operators of passenger rail services require high numbers or volumes of passengers to use their service to be commercially viable. If only a small number of passengers wish to travel on a single train at one time this can create significant operational costs for the service operator. Due to these concerns there is potential for rail network operators to restrict or limit the number of trains available to passengers in an attempt to reduce operational costs and to boost passenger numbers on each train. This however has the effect of reducing the convenience of the service for passengers, who become more likely to resort to using their own cars for transportation.

An improved transportation system that addressed any or all of the above problems would be of advantage. Specifically a transportation system which could cater cost effectively to small passenger numbers, which could provide access to wide areas of a city and which could be implemented or built at low cost would be of advantage.

It is an object of the present invention to address the foregoing problems or at least to provide the public with a useful choice.

Further aspects and advantages of the present invention will become apparent from the ensuing description that is given by way of example only.

DISCLOSURE OF INVENTION

According to one aspect of the present invention there is provided a transportation system which includes, a plurality of substantially upright supports, and at least one track elevated by said supports, and a plurality of cabs adapted to move along said at least one track, said cabs being suspended from a track so that the centre of mass of said cabs is located below the track, wherein said at least one track is formed from a first rail element and a second rail element orientated in substantially the same directions, the first rail element being used to support at least one cab moving in substantially the opposite direction to at least one second cab supported by the second rail elements.

According to a further aspect of the present invention there is provided a transportation system substantially as described above wherein one side of a cab is linked to a track to locate the cab's centre of mass below the track According to yet another aspect of the present invention there is provided a transportation system substantially as described above wherein the entire body of the cab is suspended below the track.

According to a further aspect of the present invention there is provided a transportation system substantially as described above wherein each cab includes seating for ten or less passengers.

According to another aspect of the present invention there is provided a transportation system substantially as described above which includes a switching system adapted to move a cab from a track's rail element to an adjacent track's rail element through pivoting a portion of the rail element on which the cab is moving towards a rail element of the track to which the cab is to be switched.

According to yet another aspect of the present invention there is provided a transportation system substantially as described above wherein the drive system includes a biasing means adapted to move the centre of mass of the cab towards the track onto which it is to be switched before the rail element on which the cab is moving is pivoted towards the adjacent track onto which the cab is to be switched.

According to a further aspect of the present invention there is provided a biasing means for a transportation system substantially as described above wherein the biasing means includes a hydraulic or pneumatic ram.

According to a further aspect of the present invention there is provided a transportation system which includes a control system for a cab, the control system being adapted to receive destination information from a user and to use this destination information to control the route which the cab travels along the transportation system.

According to a further aspect of the present invention there is provided a transportation system substantially as described above wherein the control system for a cab includes a currency transfer element.

The present invention may be adapted to provide a transportation system. Preferably a transportation system implemented in accordance with the present invention may be used to transport passengers or to provide a public passenger transportation system. The present invention may provide significant advantages in this application over the prior art due to its ability to satisfy passengers' needs for a timely and convenient transportation service.

Reference throughout this specification will also be made to the present invention being used to provide a passenger transportation system but those skilled in the art should appreciate that other applications are also envisioned. For example, it is also possible for the present invention to be used to transport goods if required and reference to the transportation of passengers only throughout this specification should in no way be seen as limiting.

In a preferred embodiment the present invention includes a plurality of upright supports. These supports may be used to elevate other components of the transportation system and also to support these components and place them out of the way of any obstacles that might be encountered at lower elevations. Using upright supports to elevate other components of the system also reduces the system's "footprint" or the amount of land actually taken up through implementation of the present invention.

Preferably the upright supports employed are arranged in a longitudinal array along the length of the track to be supported.

Preferably a single upright support only is used to support one point of the track.

Preferably the upright supports used may be orientated substantially perpendicular to the surface on which they are installed. Orientation of the supports this way maximises the height at which the main components of this system may be elevated to. However, those skilled in the art should appreciate that upright supports used in conjunction with the present invention need not necessarily be angled exactly perpendicular to a surface which is used to support them, and reference to the above only throughout this specification should in no way be seen as limiting.

In a preferred embodiment the transportation system includes a plurality of cabs. A cab may be defined as any at least partially enclosed compartment that is adapted to carry or transport passengers and/or goods. The present invention may be adapted to transport a plurality of cabs and hence passengers or goods residing within the cabs.

In a preferred embodiment a cab may form a fully enclosed cabin. Such a cab may also include seating for a small number of people. This in turn allows the size of the cabs used to be reduced, thereby limiting the capital costs required to implement the present invention and also the aesthetic or visual impact the system will have on its surroundings.

In a further preferred embodiment a cab may be configured to contain seating for ten or less people, and preferably may contain seating for eight passengers only. By reducing the number of passengers that can be transported by a cab this makes it easier for the cab to be filled at any time. Furthermore, the provision of small cabs also allows the frequency at which cabs travel a particular section of the transportation system to be varied easily. In times of peak passenger traffic large numbers of cabs may be shuttled through a particular area, whereas in off-peak times the number of cabs passing through may be reduced.

In a preferred embodiment the present invention may include at least one track that is elevated by the substantially upright supports discussed above. A track may be provided to guide and control the motions and paths of cabs through the transportation system formed in accordance with the present invention. Furthermore, a transportation system formed in accordance with the present invention may also include a plurality of tracks that allow cabs containing passengers to travel to many different destinations. Switching systems may be provided between tracks when adjacent to one another to allow cabs to be switched between tracks to therefore provide some variation in potential routes that a single cab can take on the transportation system.

In a preferred embodiment the present invention may be configured with a number of tracks where each of these tracks are supported or elevated by a plurality of substantially upright supports. Reference throughout this specification will also by made to the present invention including a plurality of tracks, but those skilled in the art should appreciate that the invention may be configured using a single track if required. For example, in such an embodiment the present invention may be implemented using a single track that runs in a loop or circuit.

In a preferred embodiment a track may be formed from a first rail element and a second rail element, with both elements being orientated in substantially the same direction. The first of these rail elements may be adapted to support cabs moving in the opposite direction to cabs supported by the second rail element This configuration of the invention allows a single track to support two separate cabs at numerous points along its length and also allows motion of cabs in opposite directions along opposite sides of the same track. This may be contrasted with prior art systems where a single track will only allow a cab to move in one direction only, or if cabs are run in both directions on the track, careful management and time tabling systems must be used to make sure that no impacts occur between cabs.

By providing two rail elements on either side of the same track this will substantially increase the flexibility of the transportation system with regard to the routes that cabs can take along the system, and will also substantially increase numbers of cabs and volumes of passengers which the system can transport at any one time.

In a preferred embodiment a track may be formed from a central body portion with two pairs of side arms projecting from the body portion to form the first and second rail elements. This design of track provides this component with a limited or compact width, thereby reducing the environmental and aesthetic impact of the system on its surrounding environment. The pairs of projecting side arms extending from the central body or beam of the track can in turn be employed to form first and second rail elements from which cabs are to be suspended.

Preferably cabs are suspended from rail elements so that the centre of mass of a cab is located below the track.

In a further preferred embodiment one side of a cab only may be linked to a track to locate the cab's centre of mass below the track. This offset connection scheme for a cab again assures that the cab is suspended from a track and limits the width or extent of the system and hence its impact on the surrounding environment.

Preferably a track may be linked to a cab through a drive system employed to pull or push the cab along the tracks. In such embodiments a structural beam or member may be mounted on one side or edge of a cab with drive system components connected to this beam, which are in turn connected to the track to suspend the cab from the track.

In a preferred embodiment cabs supported by a track are suspended from the track when in use. Suspending cabs from an elevated track will still elevate each cab above the ground but will restrict the total height of the transportation system and the total volume of space that it occupies. These considerations are important when evaluating the visual impact the transportation system will have on its surroundings. As the height which the cabs are elevated is preferably limited, this in turn limits the size of shadows cast onto the surrounding environment by cabs. Furthermore, by where possible reducing the volume of space occupied by the transportation system this again limits the visual impact the system will have on its surroundings when installed. These considerations are important when the transportation system is to be run through or installed within an existing suburban environment where householders may feel sensitive to their living space being dominated or overshadowed by the elevated track and cabs.

In a preferred embodiment the present invention may include a control system for a cab, where such a control system may be adapted to control the route or path which the cab takes along the transportation system. Such a control system may be in communication with other components of the transportation system such as switching systems or elements which are used to move a cab from one track onto an adjacent track to change the path or the route to be taken by the cab.

In a preferred embodiment a control system may be adapted to receive destination information from a user. Destination information may consist of a particular street address which the user wishes to travel to, a specific route to be travelled or a general locality or suburb that the user wishes to travel without being specific about a particular delivery point or location. Destination information may also encompass the user indicating the route that they wish a cab to take to a destination. Such information may be supplied to the control system using any type of known technology such as for example, computerised keypads, touch screens, or voice recognition systems. The destination information supplied to the control system may be used to pilot the cab along a predetermined route to the destination or along a route indicated by the user.

A control system as discussed above may be implemented through provision of any type of digital processing system that is capable of communicating with and issuing commands to other elements of the transportation system. For example, in a preferred embodiment the control system is adapted to transmit control signals to at least one switching system to move the cab from one track to an adjacent track. Those skilled in the art should appreciate that existing information technology systems and computer based technology may be used to implement this aspect of the present invention, and as such has not been described in detail throughout this specification.

These features of a control system substantially increase the flexibility of the transportation system and its ability to deliver passengers to particular or selected destinations. Through the control systems links with switching elements or systems it may navigate a path from the cab's present location to the destination indicated by the user. This may be contrasted with the existing public transportation systems such as buses or trans that follow a route that cannot be varied depending on the passengers' requirements.

In a further preferred embodiment such a control system for a cab may also include a currency transfer element. A currency transfer element may be used to electronically transfer funds from a passenger to a currency account associated with a person or organisation operating the transportation system. Preferably such a currency transfer element may be implemented using known existing technology such as EFTPOS or credit card systems or alternatively may deduct a set currency value from a credit account held by the passenger with the operator of the transportation system. Such a currency transfer element may greatly increase the convenience of the transportation system for passengers, as they do not need to carry coins or notes, or supply exactly the correct change for a fare.

Preferably the plurality of upright supports used may perform additional functions other than just the support of tracks used by the transportation system. These upright supports may also be used to elevate and support other non-transport related systems or articles, such as for example street lighting systems or power or telecommunications cables. Those skilled in the art should appreciate that the system of uprights may provide a basic network of support structures which can be used to also support and elevate other non-transport related components if required.

In preferred embodiment the upright supports used may also include one or more receptacles near the base or the bottom of the support. These receptacles may preferably be used to contain soil and to provide containers for plants to landscape the area immediately surrounding a support. Plantings may be provided within such containers to soften the visual impact of the supports, or to disguise or hide the supports. Furthermore, these receptacles can also form a protective crash barrier for the support involved. Containers filled with earth and plantings can create a buffer layer around the base of the support, reducing the chances of the support being damaged if it is hit by a vehicle in a road crash.

In a preferred embodiment a cab may include a drive system which is adapted to pull or push a cab along a rail element. Preferably such a drive system may be powered by electrical energy. In such instances the electrical energy used may be supplied by a live wire pickup cable located within or adjacent to the rail element on which the cab is travelling. In such instances electric motors may be used to drive the motion of a cab, reducing the potential for a cab to generate noise when in operation.

Preferably through the use of live wire pickup systems and electric driving motors the majority of the noise generated through the motion of a cab may be sourced from physical contact between driving elements of the cab and a rail element of the track. This feature of the invention may reduce the impact the transportation system will have on its environment during its operation. By limiting the amount of noise produced by a moving cab this will go some way to reducing the reluctance of residents within a particular area to having the transportation system running through same. Furthermore, if cabs can travel relatively quietly it is possible for the transportation system to operate late at night without complaints from residents within the surrounding area.

The use of a live wire pickup power supply eliminates the need for a cab to carry its own supply of fuel. As the live wire pickup used is elevated well off the ground this also reduces safety problems associated with providing uninsulated high voltage power line wires. In addition, the use of electrical driving motors instead of internal combustion engines eliminates air pollution concerns associated with operation of the transportation system.

In a preferred embodiment a drive system may be composed of or formed from at least one drive carriage. One, two or possibly more carriages may be employed in the drive system to link the cab to the track.

In a further preferred embodiment the present invention may be implemented using a drive system formed from two separate carriages only. Reference throughout this specification will also be made to the use of two carriages only but those skilled in the art should appreciate that other designs or implementations are also envisioned and reference to the above only throughout this specification should in no way be seen as limiting.

The use of two carriages provides two suspensions points for a cab on the track. When the cab is switched on to another track the first of these carriages moves the front portion of the cab towards the new track a short distance before the second carriage reaches the switching system used. This promotes a gradual change in momentum and in the direction of motion of the cab, thereby smoothing out the switching of cabs to adjacent tracks.

In a preferred embodiment a drive carriage may include a plurality of vertical guide wheels which in use engage with a side or sides of a track element. Such guide wheels may be provided to stabilise the motion of the cab in a horizontal plane through engagement of guide wheels with a side or sides of a track element.

In a further preferred embodiment the a drive carriage may include a drive wheel and a pressure wheel which in use are placed in contact with the upper and lower surfaces of the track element. The drive wheel may be rotated by the system to provide the motive power used to pull or push the cab along the track element, while the pressure wheel located on the opposite side of the track element can provide a vertical stabilisation element to the cab. Those skilled in the art should also appreciate that the drive wheel may be located above the track element and a pressure wheel below, or alternatively the pressure wheel may be located above the track element and the drive wheel below.

In a preferred embodiment a drive carriage includes a central bar with the carriage being connected to a track at two points along the length of said central bar.

In a preferred embodiment a drive carriage may be formed from or incorporate a central bar which has sets of vertical guide wheels and pressure wheels located at either end of such a bar. One drive wheel may be located at one end of the central bar, or alternatively a pair of guide wheels may be provided with one at each end of the bar. This configuration of the drive carriage again promotes the smooth switching of a cab to an adjacent track. The displacement between the contact points of carriage to the track provides a gradual change in direction of momentum of the cab over the length of the carriages central bar as the carriage is switched onto an adjacent track.

In a preferred embodiment the drive system may also include a biasing means which is adapted to move the centre mass of the cab towards the track onto which it is to be switched before the cab is actually switched over. Such a biasing means may be provided to allow smooth transitions for passengers during switching as the momentum of the cab changes. Such a biasing means may also allow cabs to be switched smoothly and at high speeds.

In a further preferred embodiment a biasing means may be formed from any element adapted to inflate or to extend its width to push the cab out from the rail element from which it is suspended.

In a further embodiment a biasing means for a drive system may be located between components of a drive system for the cab linked to a rail element, and a linking connector connected between the drive system components and the cab, where this linking connector is pivotably connected to the drive system components. In such an embodiment extension of the biasing means will pivot the main body of the cab out away from the drive system via the linking connector and therefore pivot the cab's centre of mass out and away from the rail element on which the cab is suspended before the cab is switched on to an adjacent track.

In a preferred embodiment a biasing means may be formed from or incorporates a hydraulic ram as the extendible element required. The driving shaft of such a ram can be pushed out or pulled inwards to apply the biasing force required to the cab during switching.

In a preferred embodiment the present invention may include a switching system which is adapted to move a cab from one-track rail element to an adjacent tracks rail element. Such a switching system may be adapted to vary the potential routes that a cab may travel over the transportation system.

A switching system may be located at each point along the track network of the transportation system where adjacent tracks come in close proximity to or intersect with one another. This provides great flexibility in the operation of the transportation system. In some embodiments cabs may simply run along a set route within a track network of the transportation system, whereas in other instances passengers may provide instructions or destination information to the components of the cab to indicate where they wish to travel, and from this information the cab may be transferred through the use of switching systems to the tracks which will lead to the passenger selected destination.

In a preferred embodiment the switching system may be adapted to pivot a section or component of a track's rail element towards or into contact with the rail element of an adjacent tract. The pivoted section of the rail element may then guide or carry the cab over to the new rail element of the track onto which the cab is to be switched In a further preferred embodiment a switching system may include at least one drive component which is adapted to push one end of a section of rail element outwards towards an adjacent track and also pull the same section of rail element away from said adjacent track.

For example, in one instance such a driving component may consist of or include a plurality of panels that are pivotably attached to one another at their adjacent edges. One or more drive rods may also be attached to a panel or panels where this drive rod or rods are adapted to push the pivotably attached panels so that they will lie substantially in the same plane. Such a drive rod or rods may also be used to pull the panels so they will lie substantially parallel to one another.

These panels and drive rod or rods may be located between the interior side of a section of rail element to be pivoted outwards and the main body of the track at the particular point on the network. A drive rod used may be actuated to push the pivotably connected panels into the same plane which will thereby place a pivoting force on one point of the inner face of the section of rail element involved. This pivoting force will pivot the end of the rail element section outwards thereby switching a cab onto an adjacent track Once the cab has been switched the drive rod or rods may then be pulled backwards to pull all the panels so that they will lie substantially parallel with one another to compact up into a small volume between the section of rail element and the main body of the track.

In a further preferred embodiment the switching system may also include a second drive component or drive arm to provide a pushing or pulling force in a direction substantially perpendicular to force applied by the drive rod connected to the pivoting panels discussed above. Such a drive arm can assist in starting the motion of the switching system just as the switch begins to open or close. Such a drive arm can provide an initial strong force used to get the panels moving, with the drive rod or rods directly connected to these panels assisting in this action once the panels are moving. Such a drive arm may be located above or below, or to one side of the pivoting panels employed and can be formed from any form of extendible or moveable components. For example, in one further preferred embodiment such a drive arm of a switching system may be formed from a hydraulic or pneumatic ram.

The present invention provides many potential advantages over existing prior art transportation systems.

The present invention may be implemented at relatively low capital cost due to the small scale at which the cabs discussed above are constructed. Furthermore, as small cabs are used this also restricts the overall size of the upright supports and tracks needed, thereby reducing the environmental or aesthetic impact of the resulting transportation system on the area in which it is to be installed.

By allowing only a relatively small number of passengers to be carried in each cab this provides the system with significant flexibility with regard to how it will transport large numbers of passengers. At off peak times only a small number of cabs may be in circulation on the system, whereas during peak flow or at rush hour times the majority of cabs in existence for the system may be in circulation along same.

A control means and switching systems discussed above for cabs also allows a great degree of flexibility with regard to where a particular cab can travel on the transportation system. By allowing passengers to specify their end destination and, with appropriate switches made to the tracks required a cab can deliver passengers close to their specified destination.

BRIEF DESCRIPTION OF DRAWINGS

Further aspects of the present invention will become apparent from the following description that is given by way of example only and with reference to the accompanying drawings in which.

BEST MODES FOR CARRYING OUT THE INVENTION

Figure 1B:
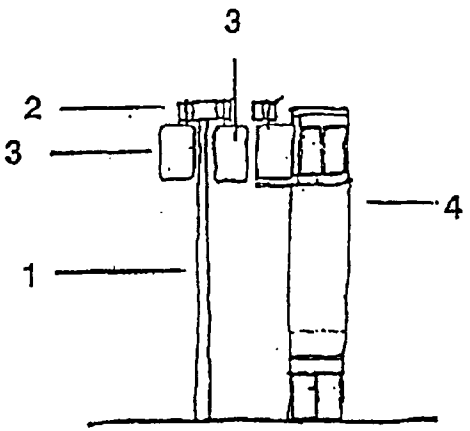
FIGS. 1*a*,1*b* show end views of components the transportation system configured in accordance with one embodiment.
Figure 1A:
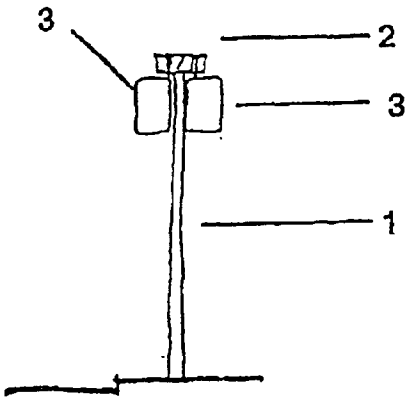

FIGS. 1*a* and 1*b* show two cross section end views of components used to implement a transportation system configured in accordance with one embodiment of the present invention.

In such an instance the transportation system may include a number of substantially upright supports 1 which are used to elevate and support at least one track 2. Preferably one support may be configured to support a single track only in one instance, where additional supports may be provided to elevate and support other tracks also used to implement the transportation system.

Each track 2 is provided to support and suspend a number of cabs 3, which in the embodiment shown are used to carry passengers. Preferably each track 2 is adapted to support and suspend two cabs only—with these cabs in use travelling in opposite directions to one another. To achieve this aim the track may be formed from or include a first rail element and a second rail element (not shown in FIGS. 1*a*,1*b*) which are positioned on opposite sides of the track formed. Cabs 3 may then run along the opposite sides of the track in different directions.

At certain points along the length of the track 2 there may also be provided passenger stations 4 which allow passengers to climb to the level of the cabs and to enter cabs to be transported. Those skilled in the art should appreciate that any configuration, arrangement or design of stations may be used in conjunction with the present invention to allow passengers to easily and quickly enter or exit cabs. For example in one embodiment a station may be provided as part of the second floor of a shopping mall or other commercial building which will allow passengers to exit the cab above the first floor of a retail area or business district. Such buildings may provide convenient stations as they include areas already elevated to the level of the cabs.

Figure 2:
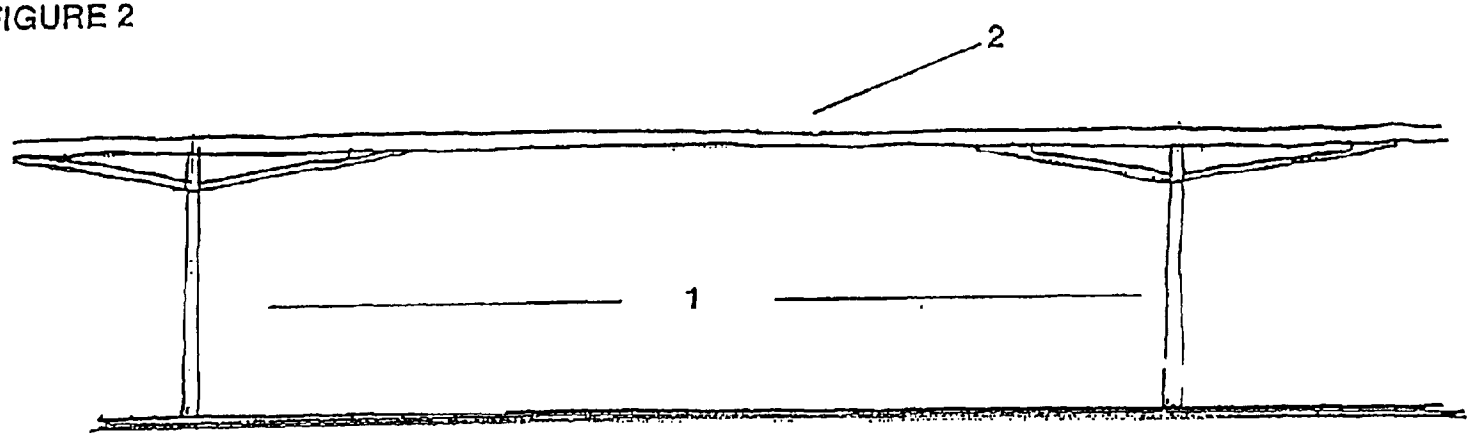
FIG. 2 shows a side view of a number of upright supports and a track used in the same embodiment shown with respect to FIGS. 1*a*,1*b*.

FIG. 2 shows a side view of a number of substantially upright supports 1 and a track 2 configured in accordance with the same embodiment shown with respect to FIGS. 1*a*,1*b*. As shown in FIG. 2 each of the upright supports 1 is used to elevate the track 2 at a height well above any obstacles, structures or roadways which could interfere with the passage of cabs along the track 2.

Figure 3:
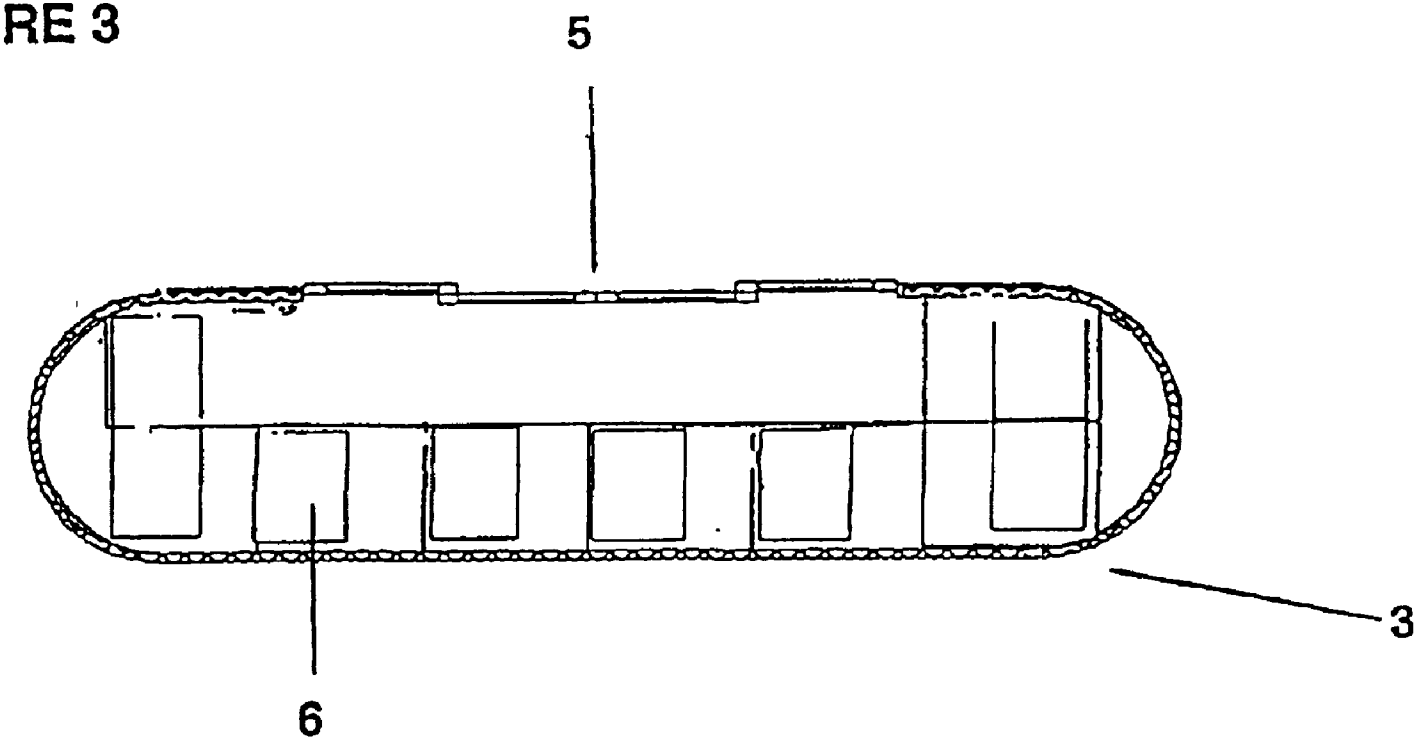
FIG. 3 shows a plan view of a cab configured in accordance with the embodiment of the present invention shown in FIGS. 1*a*, 1*b*, and FIGS. 4*a*,4*b* show cross section end and side views of a cab and track as configured in a further embodiment of the present invention.

FIG. 3 shows a top cross-sectional view of a cab 3 as configured in accordance with the embodiment shown with respect to FIGS. 1*a*,1*b*. The cab 3 includes an entry and an exit door 5 that leads into the centre of a fully enclosed cabin. The cab also includes seats 6 for eight adult people only. By providing seating for eight people only the materials and work required to construct a cab 3 is substantially reduced Furthermore, the small size of the cab also allows the operators of the transportation system greater flexibility with regard to where and when they can send cabs to pick up and deliver passengers as demand for transportation fluctuates during a day. As should be appreciated by those skilled in the art this flexibility may be achieved by providing less than ten seats within a cab, as is illustrated by the example shown with respect to FIG. 3.

Figure 4B:
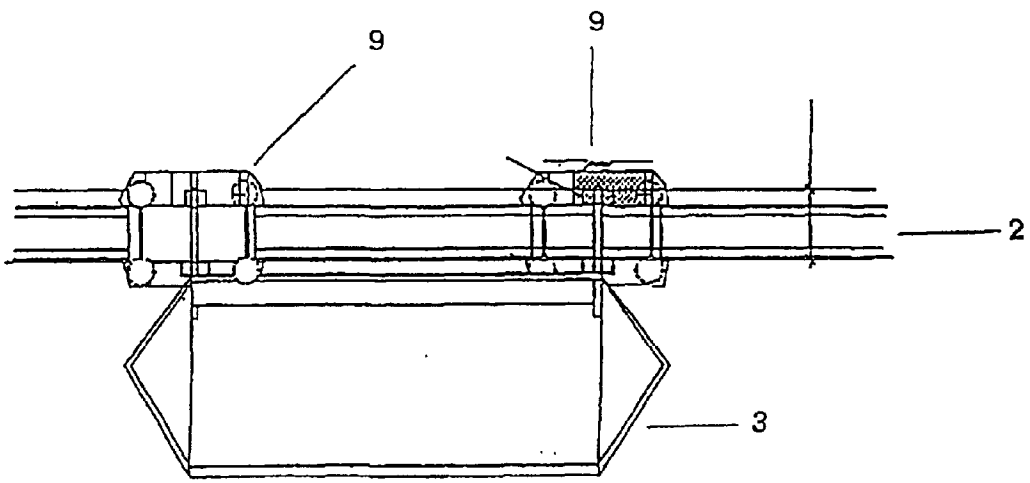
Figure 4A:
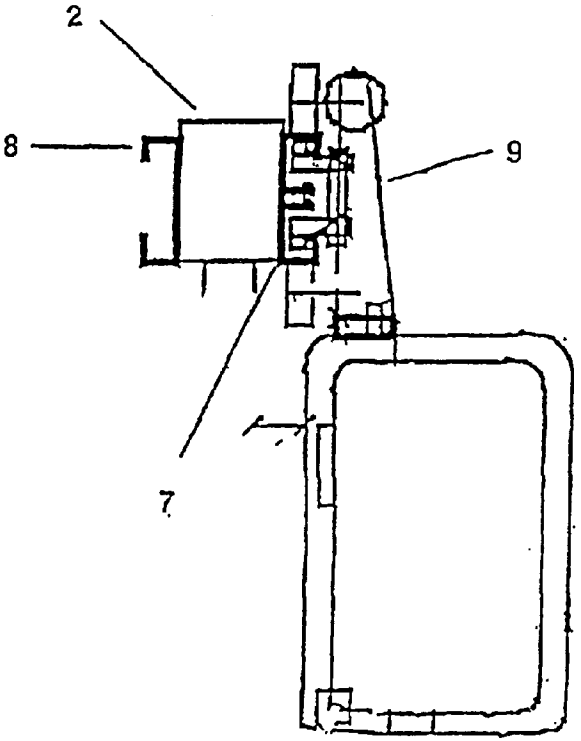

FIGS. 4*a* and 4*b* show an end cross section and side cross section view of a cab and track as configured in accordance with another embodiment of the present invention. As can be seen from FIG. 4*a* the track 2 is formed from or includes on each of its opposite faces a first rail element 7 and a second rail element 8. The first rail element 7 is shown supporting a cab 3 which is adapted to move in a direction orientated substantially out of the page. Conversely the second track element is adapted to support and guide the motion of a cab or cabs moving in the direction orientated substantially into the page.

Also shown with respect to FIGS. 4*a* and 4*b* is a pair of drive carriages 9 forming a drive system used to pull the cab 3 along the track 2. Each cab is suspended and driven by two drive carriages 9.

Figure 5:
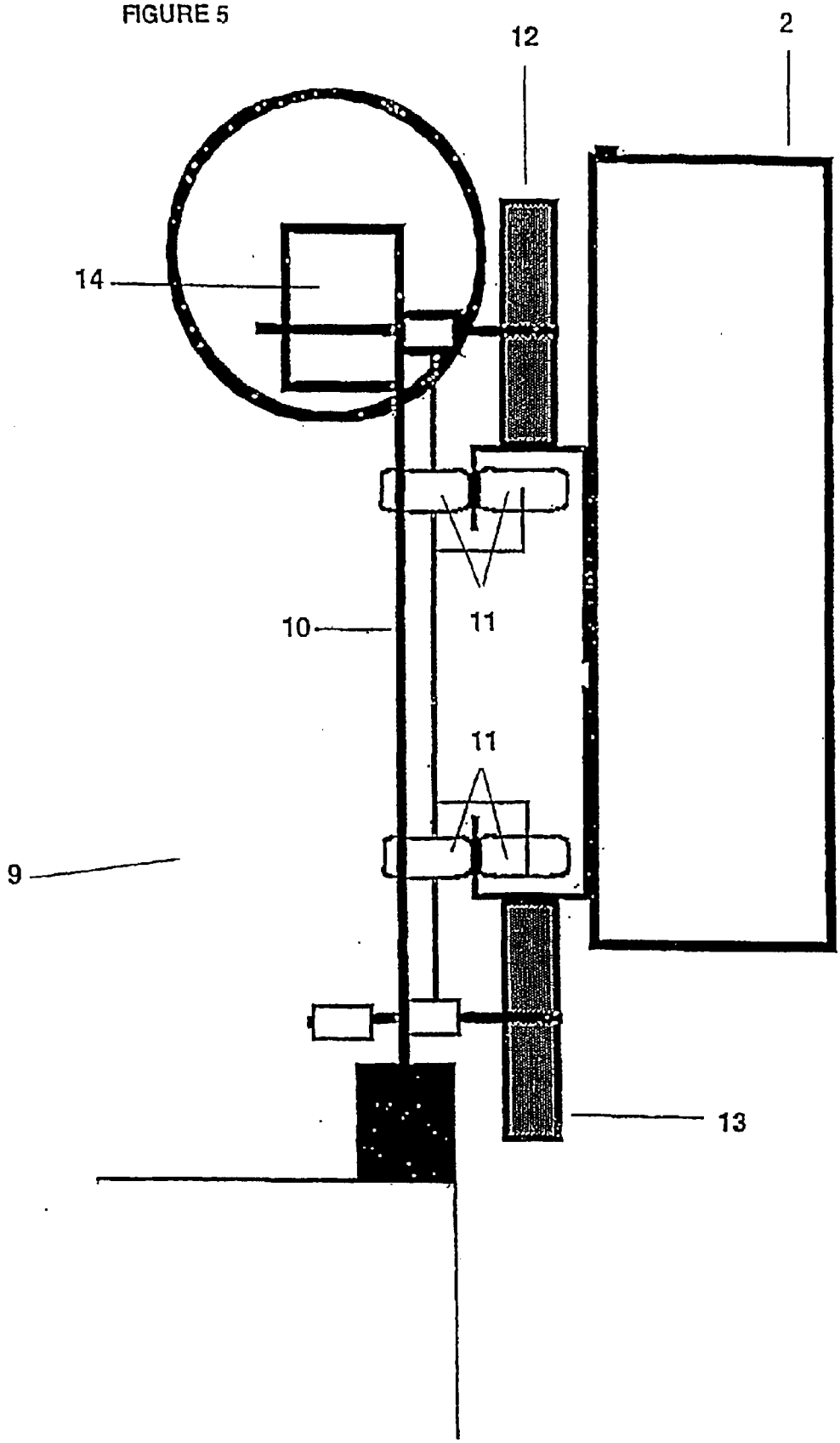
FIG. 5 shows a cross section end view of a drive carriage used in the embodiment of the present invention shown with respect to FIGS. 4*a* and 4*b*, and FIGS. 6*a*,6*b*,6*c* show the progress of a single drive carriage of a cab when moved with a switching system configured in accordance with a further embodiment.

FIG. 5 shows an enlarged cross section side view of a drive carriage 9 as used in the embodiment illustrated by FIGS. 4*a* and 4*b*. The drive carriage 9 is adapted to engage with and connect to a rail element 8 to support and guide and drive the motion of the cab along the track 2 (not fully shown). The drive carriage 9 includes a framework 10 on which a number of vertical guide wheels 11 are located. The vertical guide wheels 11 engage with vertical flanges formed in the body of each rail element to lock the drive element 9 onto the rail element. This framework also supports and locates a pair of drive wheels 12 and a pair of vertical pressure wheels 13. The end view of FIG. 5 shows only the first of the pairs of drive and vertical pressure wheels. The drive wheel 12 is associated with and driven by an electric motor 14 which rotates the drive wheel 12 and hence pulls the drive element 9 and associated cab along the rail element 8. As can be appreciated by those skilled in the art the pressure wheel 13 may also be driven by the electric motor 14 if required.

Also shown with respect to FIG. 5 is a mounting beam 10*b* which depends from framework 10 incorporated into the drive element. This mounting beam extends past the drive element to other drive elements incorporated into the system and is used to directly connect or link a cab to the drive system and associated drive elements.

Figures 6A, 6B, 6C:
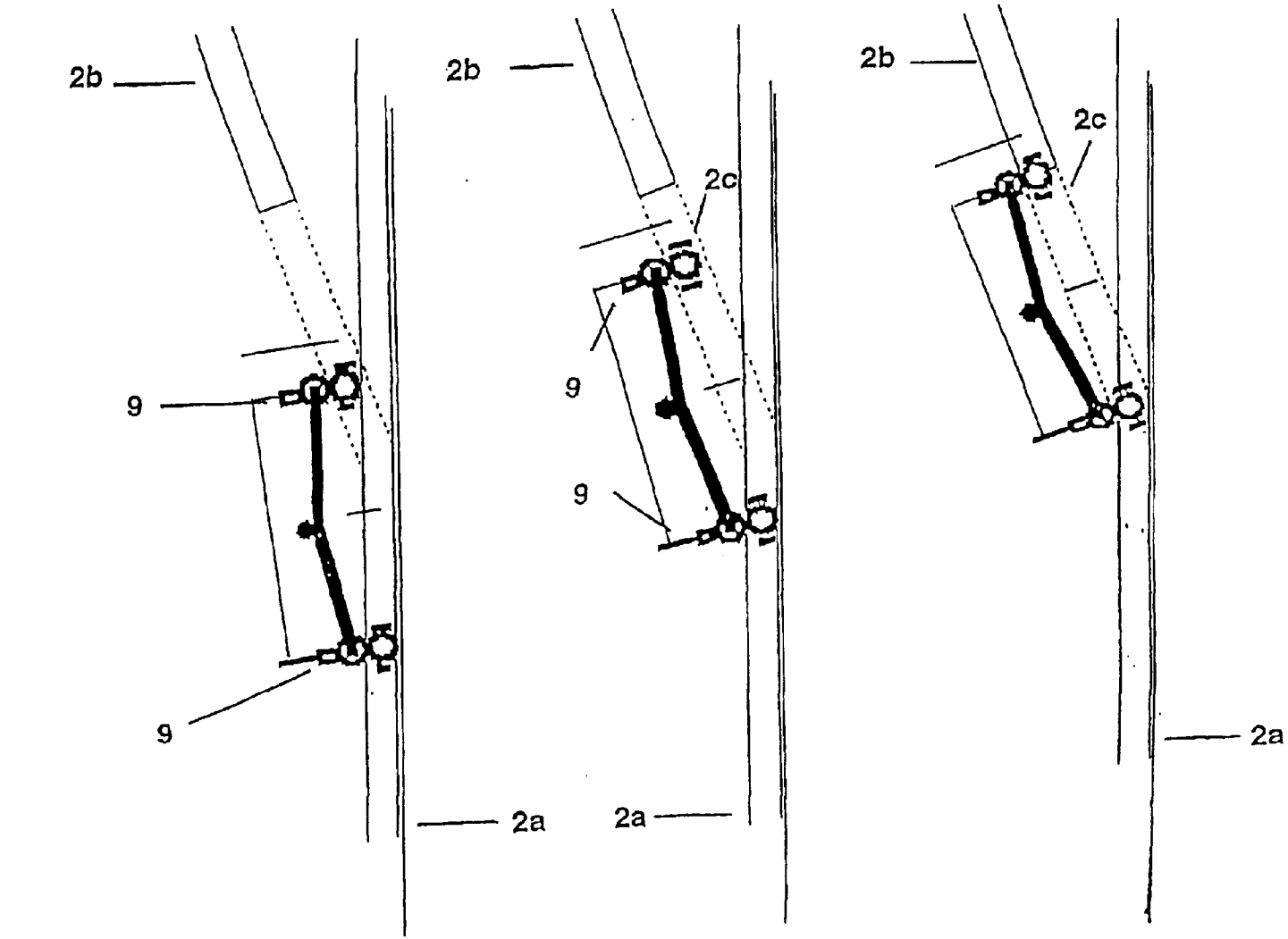

FIGS. 6*a*, 6*b* and 6*c* show the motion of a single drive carriages 9 on the top of a cab as the cab is switched onto an adjacent track In the instance shown with respect to FIG. 6*a* the cab (not shown) is initially travelling along a first track 2*a* and is to be switched onto an adjacent track 2*b*. To implement the switch of a cab a portion of the track 2*a* is adapted to pivot outwards towards the second track 2*b*. This pivoting section of the track 2*a* is shown as the dotted section 2*c*. In effect only a portion of the track 2*a* is used to form the section 2*c* by pivoting out the section of the rail element of the track on which the cab is travelling. As shown in FIGS. 6*a*, 6*b* and 6*c* this rail element when pivoted outward guides each drive carriage 9 and the associated cab outwards away from the original track 2*a* onto the new track 2*b*. Once the cab has been fully transferred onto the new track 2*b*, the section of rail element 2*c* may be pivoted back into line with the main body of the track 2*a*.

Figure 7A:
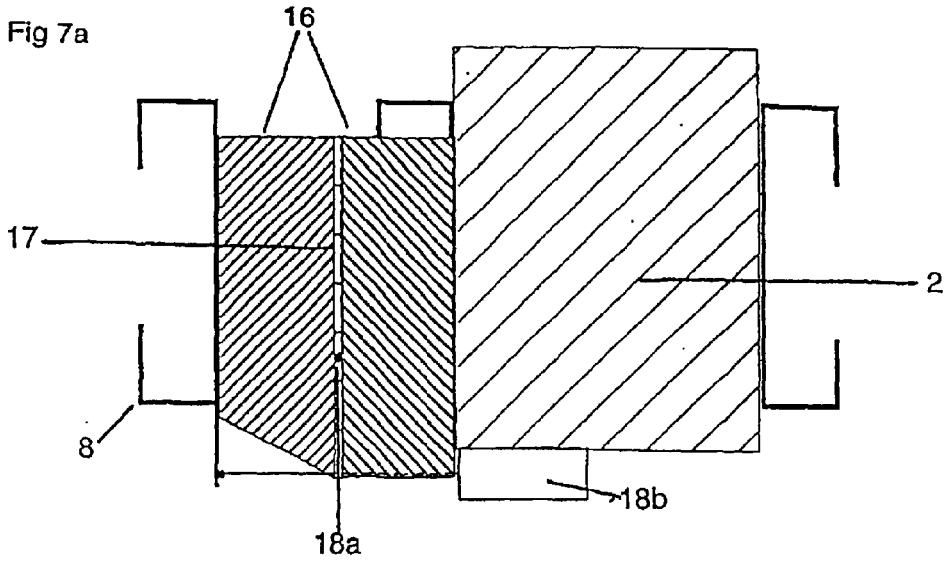
FIG. 7 shows side and top schematic views of components used to implement a switching system in accordance with another embodiment of the present invention.
Figure 7B:
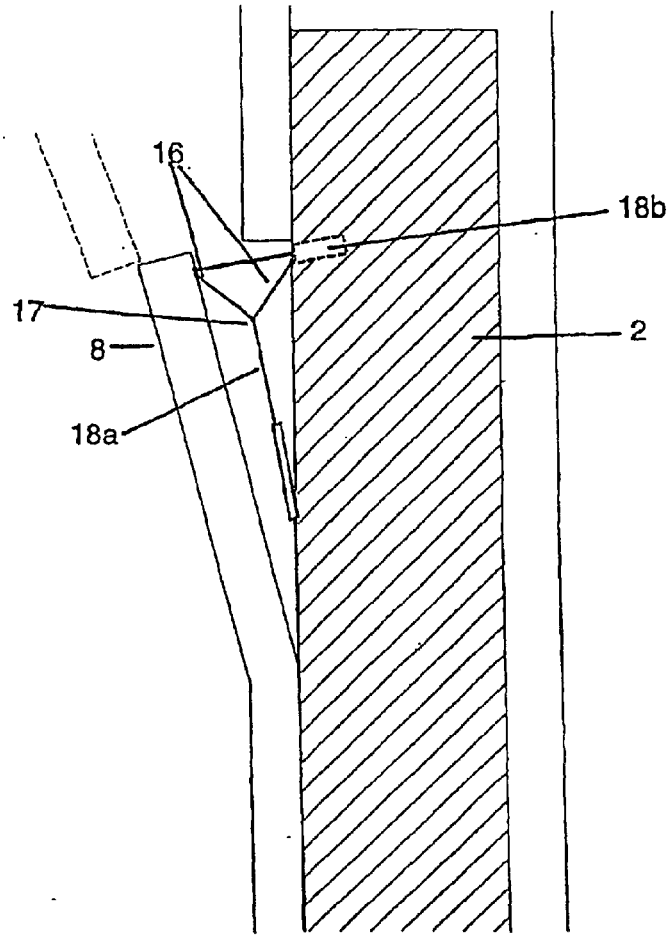

FIGS. 7*a*,7*b* show side and top schematic views of elements used to form a switching system as described with respect to FIGS. 6*a*, 6*b* and 6*c*. The switching system 15 incorporates a pair of panels 16 connected together via a hinge element 17 along their adjacent edges. Connected to the hinge 17 is a drive rod 18*a* that can apply a pushing or pulling force to the hinge 17. In the situation shown with respect to FIGS. 7*a* and 7*b* the drive rod 18*a* is used to push the panel 16 so that they will lie substantially in the same plane. This will in turn pivot outwards the rail element 8 from main body of a track 2. Conversely when the rail element 8 is to be pivoted back in close proximity to the main body of the track 2, the drive rod 18*a* may be used to push or pull the panels so that they will lie substantially parallel to one another within a relatively small volume. This will in turn pull the rail element 8 back into contact with the main body of the track 2.

In some embodiments a switching system may also include a drive arm 18*b* forming a pushing or pulling element (such as a pneumatic or hydraulic ram) which is attached to one end of the rail element 8. The opposite end of such an arm 18*b* engages with the main body of the track or other associated components to start the rail element 8 moving outwards to switch a cab or back inwards after a cab has been switched.

Figure 8:
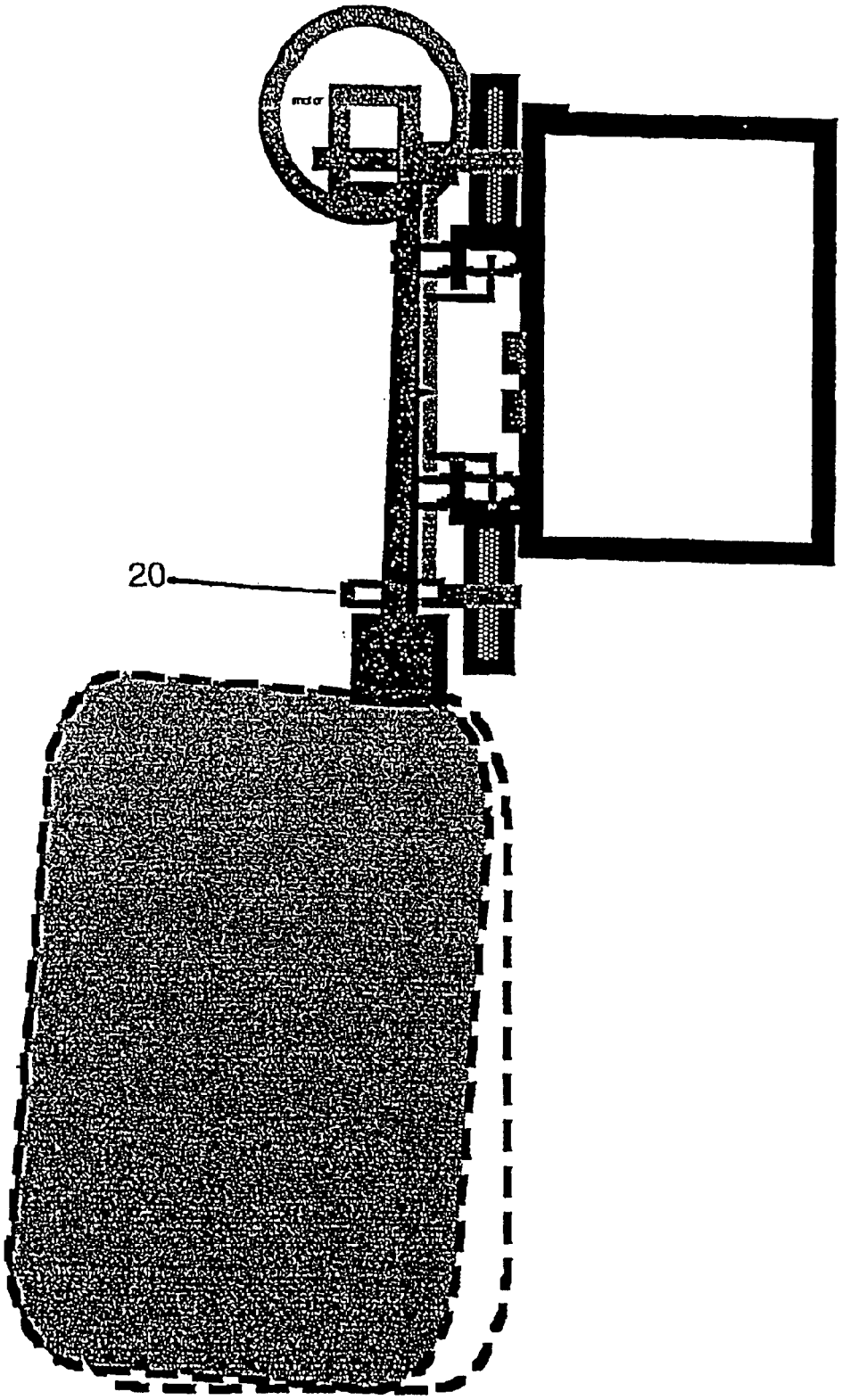
FIG. 8 shows the action of a biasing means in an end view of the system shown with respect to Figure

FIG. 8 shows the action of a biasing means introduced into the drive system for a cab. Such a biasing means can pivot or tilt the cab as shown by the ghosted cab outline in FIG. 8 to smooth out momentum changes during cab switching.

A biasing means, implemented in the embodiment shown by a hydraulic ram 20 is introduced between a drive system carriage and a connecting lever pivotably connected to the carriage and directly connected to a top mounting bar on the roof of the cab. The hydraulic ram is sited on the drive carriage and pushes against this pivoting lever to move the cab as shown with respect to FIG. 8 before the cab reaches a switching system. Prior movement of the cab before it is switched smoothes momentum changes in the cab and therefore provides a smoother ride for the cab's passengers.

Aspects of the present invention have been described by way of example only and it should be appreciated that modifications and additions may be made thereto without departing from the scope thereof as defined in the appended claims.

The claims defining the invention are:

1. A transportation system, comprising:

a plurality of substantially upright supports, a longitudinal beam elevated by said supports, a plurality of cabs adapted to move along said beam, said cabs being suspended from the beam so that the centre of mass of the cabs is below the beam, and a first rail element and a second rail element, the first rail element being disposed along a first surface of the beam, and the second rail element being disposed along a second surface of the beam, the second surface being oriented to be substantially parallel to and oppositely facing with respect to the first surface, wherein the first rail element is adapted to support at least one of said cabs moveable in an opposite direction to at least a second one of said cabs supported by the second rail element, said beam including a central body, wherein each of said rail elements project out from the central body of said beam, and wherein a single upright support only is required to support one point of the beam.

2. A transportation system as claimed in claim 1 wherein one side of each of said cabs is linked to said beam to locate the center of mass of said cab below the beam.

3. A transportation system as claimed in claim 1 wherein the entirety of each of said cabs is suspended below the beam.

4. A transportation system as claimed in claim 1 wherein each of the cabs includes seating for ten or less passengers.

5. A transportation system as claimed in claim 1 wherein each of the cabs provides a fully enclosed cabin.

6. A transportation system as claimed in claim 1 which further comprises a second longitudinal beam adjacent to the longitudinal beam, and a switching system which is adapted to pivot a portion of said first rail element or a portion of said second rail element towards a further rail element located on said second beam to enable one of the cabs moving on said first or second rail element to be switched to said further rail element.

7. A transportation system as claimed in claim 6 wherein the switching system includes at least one drive component adapted to push one end of the portion of the first or second rail element towards said adjacent second beam and to subsequently pull said pivoted rail element away from said adjacent beam.

8. A transportation system as claimed in claim 1 which further includes a drive system adapted to pull or push each of the cabs along said first or second rail element.

9. A transportation system as claimed in claim 8 wherein said drive system is powered by electrical energy.

10. A transportation system as claimed in claim 9 wherein a live wire pickup system distributed within or adjacent to the rail elements is used to supply said electrical energy to the drive system.

11. A transportation system as claimed in claim 8 wherein the drive system includes a pair of drive carriages disposed along one side of each of the cabs.

12. A transportation system as claimed in claim 11 wherein each of said drive carriages includes a plurality of vertical guide wheels which in use engage with a side or sides of said first or second rail element.

13. A transportation system as claimed in claim 11 wherein each of said drive carriages includes a drive wheel and a pressure wheel which in use are placed in contact with upper and lower surfaces of said first or said second rail element.

14. A transportation system as claimed in claim 1 wherein there is provided one or more receptacles at the base of the supports adapted to contain soil and plants.

15. A transportation system as claimed in claim 1 which further includes a control system for each of the cabs adapted to receive destination information from a user, where said destination information is used by the control system to control the route which the associated cab travels along the transportation system.

16. A transportation system as claimed in claim 15 wherein the destination information includes a street address.

17. A transportation system as claimed in claim 15 wherein the destination information includes a path or route along which a passenger of the cab wishes the cab to pass.

18. A transportation system as claimed in claim 15 wherein the control system is adapted to transmit control signals to at least one switching system to move the cab from said longitudinal beam to an adjacent beam.

19. A transportation system as claimed in claim 15 wherein the control system includes a currency transfer element.

20. A transportation system, comprising:

a plurality of substantially upright supports, a longitudinal beam elevated by said supports, a plurality of cabs adapted to move along said beam, said cabs being suspended from the beam so that the centre of mass of the cabs is below the beam, and a first rail element and a second rail element, the first rail element being disposed along a first surface of the beam, and the second rail element being disposed along a second surface of the beam, the second surface being oriented to be substantially parallel to and oppositely facing with respect to the first surface, wherein the first rail element is adapted to support at least one of said cabs moveable in an opposite direction to at least a second one of said cabs supported by the second rail element, said beam including a central body, wherein each of said rail elements project out from the central body of said beam, wherein said transportation system further includes a drive system adapted to pull or push each of the cabs along said first or second rail element, wherein the drive system includes a pair of drive carriages disposed along one side of each of the cabs, and wherein each of said drive carriages includes a central bar and is connected to a drive element at two points along the length of said central bar.

21. A transportation system, comprising:

a plurality of substantially upright supports, a longitudinal beam elevated by said supports, a plurality of cabs adapted to move along said beam, said cabs being suspended from the beam so that the centre of mass of the cabs is below the beam, and a first rail element and a second rail element, the first rail element being disposed along a first surface of the beam, and the second rail element being disposed along a second surface of the beam, the second surface being oriented to be substantially parallel to and oppositely facing with respect to the first surface, wherein the first rail element is adapted to support at least one of said cabs moveable in an opposite direction to at least a second one of said cabs supported by the second rail element, said beam including a central body, wherein each of said rail elements project out from the central body of said beam, wherein said transportation system further comprises a second longitudinal beam adjacent to the longitudinal beam, a switching system which is adapted to pivot a portion of said first rail element or a portion of said second rail element towards a further rail element located on said second beam to enable one of the cabs moving on said first or second rail element to be switched to said further rail element, and a drive system adapted to pull or push each of the cabs along said first or second rail element and wherein the drive system includes a biasing element adapted to move the centre of mass of one of the cabs towards the second longitudinal beam, to which the cab is to be switched, before the first or second rail element on which the cab is moving is pivoted towards the second longitudinal beam.

22. A transportation system as claimed in claim 21 wherein the biasing element is located between the drive system and a linking connector between the drive system and said cab to be switched to, said linking connector being pivotably connected to the drive system.

23. A transportation system as claimed in claim 21 wherein extension of the biasing element pivots the cab to be switched out away from the drive system and the associated first or second rail element which the cab is suspended from.

24. A transportation system, comprising:

a plurality of substantially upright supports, at least one beam only elevated by said supports, and a plurality of cabs adapted to move along said at least one beam, said cabs being suspended from the beam so that the centre of mass of said cabs are located below the beam, wherein said beam is formed from a first rail element and a second rail element orientated in substantially the same direction, the first rail element being used to support at least a first one of the cabs moving in substantially the opposite direction to at least a second one of the cabs supported by the second rail element, said beam including a central body, wherein each of said rail elements is formed from a pair of side arms projecting out from the central body of the beam, the transportation system further comprising:

a second beam adjacent to said at least one beam, and a switching system adapted to pivot a portion of said first or second rail element on which one of the cabs is moving towards a rail element of said adjacent second beam to which the cab is to be switched to, the switching system comprising at least one drive component adapted to push one end of the portion of said first or second rail element towards said adjacent second beam and to pull said pivoted rail element away from said adjacent second beam, wherein the drive component includes a plurality of panels attached to one another at adjacent edges which are moveable to orientate the panels substantially parallel or perpendicular to one another to pivot the portion of said first or second rail element towards or away from the adjacent second beam.

25. The transportation system of claim 24 wherein the switching system further comprises at least one driving rod or at least one driving arm adapted to push and pull the panels into substantially parallel or perpendicular alignment with one another.

26. A transportation system, comprising:

a plurality of substantially upright supports, a single beam only elevated by said supports, and a plurality of cabs adapted to move along said beam, said cabs being suspended from the beam so that the centre of mass of said cabs are located below the beam, wherein said beam is formed from a first rail element and a second rail element orientated in substantially the same direction, the first rail element being used to support at least a first one of the cabs moving in substantially the opposite direction to at least a second one of the cabs supported by the second rail element, said beam including a central body, wherein each of said rail elements is formed from a pair of side arms projecting out from the central body of the beam, the transportation system further comprising a drive system adapted to pull or push each of the cabs along said first or second rail element, wherein the drive system includes a pair of drive carriages disposed along one side of each of the cabs, and wherein each of said drive carriages includes a plurality of vertical guide wheels which in use engage with a side or sides of said first or second rail element.

* * * * *